US009222724B2

(12) United States Patent
Fischer et al.

(10) Patent No.: US 9,222,724 B2
(45) Date of Patent: Dec. 29, 2015

(54) NATURAL GAS LIQUEFACTION METHOD WITH HIGH-PRESSURE FRACTIONATION

(75) Inventors: Béatrice Fischer, Lyons (FR); Gilles Ferschneider, Chaponay (FR); Anne Claire Lucquin, Saint Maurice L'Exil (FR)

(73) Assignee: IFP Energies Nouvelles, Rueil-Malmason (FR)

( * ) Notice: Subject to any disclaimer, the term of this patent is extended or adjusted under 35 U.S.C. 154(b) by 1092 days.

(21) Appl. No.: 12/739,243

(22) PCT Filed: Oct. 17, 2008

(86) PCT No.: PCT/FR2008/001462

§ 371 (c)(1),
(2), (4) Date: Oct. 26, 2010

(87) PCT Pub. No.: WO2009/087308

PCT Pub. Date: Jul. 16, 2009

(65) Prior Publication Data

US 2011/0048067 A1 Mar. 3, 2011

(30) Foreign Application Priority Data

Oct. 26, 2007 (FR) ..... 07 07829

(51) Int. Cl.
*F25J 1/00* (2006.01)
*F25J 3/00* (2006.01)
(Continued)

(52) U.S. Cl.
CPC ..... *F25J 3/0238* (2013.01); *F25J 1/0022* (2013.01); *F25J 1/0052* (2013.01); *F25J 1/0085* (2013.01); *F25J 1/025* (2013.01); *F25J 1/0214* (2013.01); *F25J 1/0231* (2013.01); *F25J 1/0237* (2013.01); *F25J 1/0238* (2013.01); *F25J 1/0292* (2013.01); *F25J 3/0209* (2013.01); *F25J 3/0233* (2013.01);
(Continued)

(58) Field of Classification Search
CPC ..... F25J 3/0209; F25J 3/0233; F25J 3/0238; F25J 3/0242; F25J 2200/50; F25J 2200/74; F25J 2270/12; F25J 2215/62; F25J 1/0237; F25J 1/0238; F25J 1/0022; F25J 1/0214; F25J 1/0231; F25J 1/025; F25J 1/0292
USPC ..... 62/612, 632, 611, 606, 618, 620, 627, 62/623, 630
See application file for complete search history.

(56) References Cited

U.S. PATENT DOCUMENTS 4,592,767 A * 6/1986 Pahade et al. ..... 62/623
4,689,063 A * 8/1987 Paradowski et al. ..... 62/627
(Continued)

OTHER PUBLICATIONS

McCabe, W. L.; et al; "Unit Operations of Chemical Engineering," 5th Ed., McGrraw-Hill, New York, 1993.*

*Primary Examiner* — Frantz Jules
*Assistant Examiner* — Keith Raymond
(74) *Attorney, Agent, or Firm* — John Sopp; Anthony Zelano; Brion Heaney

(57) ABSTRACT

The method provides liquefaction of a natural gas by carrying out the following stages: cooling the natural gas; feeding the cooled natural gas into a fractionating column so as to separate a methane-rich gas phase and a liquid phase rich in compounds heavier than ethane; and liquefying the methane-rich stream so as to obtain the liquid natural gas. According to the invention, the operating conditions in the fractionating column are so selected that said liquid phase comprises a molar proportion of methane ranging between 10% and 150% of the molar proportion of ethane.

8 Claims, 3 Drawing Sheets

(51) Int. Cl.
*F25J 3/02* (2006.01)
*F25J 1/02* (2006.01)

(52) U.S. Cl.
CPC ..... *F25J 3/0242* (2013.01); *F25J 2200/02* (2013.01); *F25J 2200/30* (2013.01); *F25J 2200/50* (2013.01); *F25J 2200/74* (2013.01); *F25J 2215/62* (2013.01); *F25J 2270/12* (2013.01); *F25J 2290/12* (2013.01)

(56) References Cited

U.S. PATENT DOCUMENTS

| | | | | |
|---|---|---|---|---|
| 6,116,051 | A * | 9/2000 | Agrawal et al. | 62/630 |
| 6,401,486 | B1 * | 6/2002 | Lee et al. | 62/630 |
| 6,662,589 | B1 * | 12/2003 | Roberts et al. | 62/425 |
| 2007/0157663 | A1 * | 7/2007 | Mak et al. | 62/620 |

* cited by examiner

NATURAL GAS LIQUEFACTION METHOD WITH HIGH-PRESSURE FRACTIONATION

FIELD OF THE INVENTION

The present invention relates to the sphere of natural gas liquefaction.

BACKGROUND OF THE INVENTION

Natural gas is often produced far away from the sites where it is intended to be used. A method used for transporting it consists in liquefying the natural gas around −160° C. and in transporting it by ship in liquid form at atmospheric pressure.

Prior to being liquefied, the natural gas has to undergo various treatments in order, on the one hand, to adjust its composition with a view to sale (sulfur and carbon dioxide content, calorific value) and, on the other hand, to allow liquefaction thereof. In particular, natural gas fractionation carried out by distillation allows to remove the heavier hydrocarbons likely to clog, through crystallization, the lines and the heat exchangers of the liquefaction plant. Furthermore, fractionation by distillation allows to separately recover compounds such as ethane, propane or butane that can be upgraded separately, for example for sale or as cooling fluids used in the liquefaction process.

Liquefaction is generally carried out at a pressure approximately equal to the operating pressure of the fractionating column.

The present invention aims to modify the fractionation stage by increasing the fractionation operating pressure and, consequently, by increasing the pressure at which the natural gas is liquefied so as to improve the overall efficiency of the liquefaction method.

SUMMARY OF THE INVENTION

In general terms, the invention defines a natural gas liquefaction method wherein the following stages are carried out:

a) cooling the natural gas, b) feeding the cooled natural gas into a fractionating column so as to separate a methane-rich gas phase and a liquid phase rich in compounds heavier than ethane, c) withdrawing said liquid phase at the bottom of the fractionating column and discharging said gas phase at the top of the separation column, d) partly liquefying said gas phase so as to produce a condensate and a gas stream, said condensate being recycled to the top of the fractionating column as reflux, e) liquefying said gas stream, and wherein the operating conditions in the fractionating column are so selected that said liquid phase comprises a molar proportion of methane ranging between 10% and 150% of the molar proportion of ethane in said phase.

According to the invention, the operating conditions in the fractionating column can be so selected that said liquid phase comprises a molar proportion of methane ranging between 40% and 70% of the molar proportion of ethane. The molar proportion of methane of said liquid phase can be adjusted by modifying the power of a reboiler arranged in the bottom of the fractionating column.

According to the invention, the following stages can also be carried out f) feeding said liquid phase into a separation column to separate a methane-rich gas fraction and a liquid fraction comprising hydrocarbons heavier than ethane, g) withdrawing a liquid portion from the separation column, h) extracting from said liquid portion a liquid stream comprising more than 95% by mole of ethane.

In stage g), the liquid portion can be withdrawn at a level located between the supply point and the top of the separation column.

In stage h), part of said liquid portion can be vaporized so as to obtain said liquid stream comprising more than 95% by mole of ethane, said vaporized part being fed into the separation column.

A liquid reflux can be fed into the top of the separation column at a temperature ranging between −10° C. and −40° C.

In stage a), the natural gas can be cooled by heat exchange with a cooling fluid circulating in a cooling circuit and said methane-rich gas fraction obtained in stage f) can be partly condensed by heat exchange with a portion of said cooling fluid, so as to obtain said liquid reflux fed to the top of the separation column.

The cooling fluid portion can be subcooled by heat exchange with a liquid withdrawn from the fractionating column.

In stage e), the gas stream can be cooled by heat exchange at a pressure above 50 bars.

BRIEF DESCRIPTION OF THE FIGURES

Other features and advantages of the invention will be clear from reading the description hereafter, with reference to the accompanying figures wherein.

DETAILED DESCRIPTION

Figure 1:
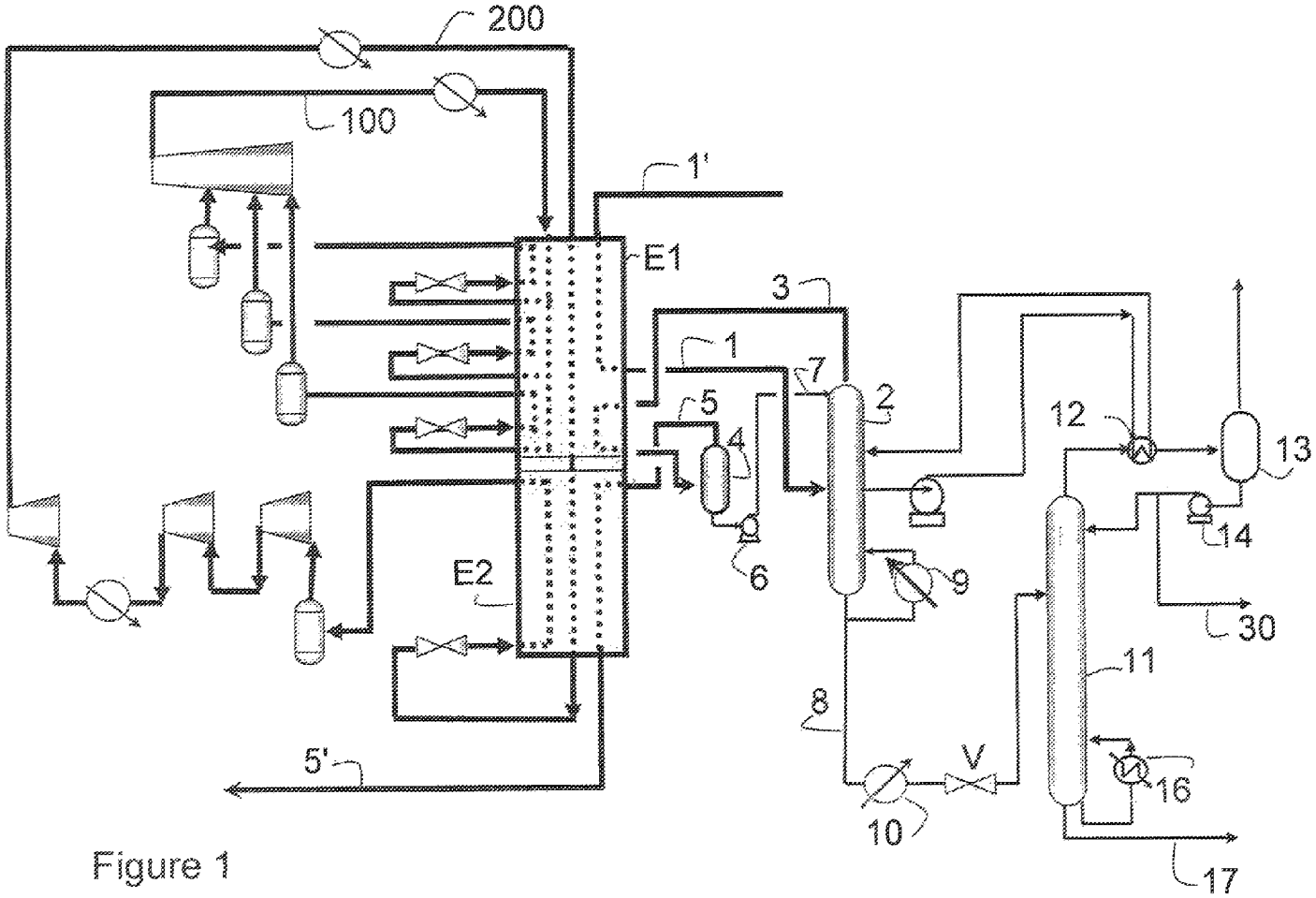
Figure 1 PRIOR ART
FIG. 1 diagrammatically shows a method according to the prior art.

In FIG. 1, the natural gas to be liquefied flows in through line 1'. The natural gas may have first been purified to remove the acid compounds, the water and possibly the mercury. The natural gas circulating in line 1' is cooled in heat exchanger E1 to a temperature ranging between 0° C. and −60° C. In E1, cooling is carried out by means of closed cooling circuit 100 that works by compression and expansion of a cooling fluid, consisting for example of a mixture of ethane and propane.

The natural gas partly liquefied in E1 is fed through line 1 into fractionating column 2, rebelled by means of heat exchanger 9. The vapour discharged at the top of column 2 through line 3 is partly condensed in heat exchanger E1 prior to being fed into reflux drum 4.

The gas fraction discharged at the top of drum 4 is sent through line 5 to heat exchanger E2 to be liquefied. The liquid natural gas is discharged from E2 through line 5'. In E2, cooling is carried out by means of closed cooling circuit 200 that works by compression and expansion of a cooling fluid, consisting for example of a mixture of nitrogen, of methane and of ethane.

The liquid obtained at the bottom of drum 4 is fed through pump 6 and line 7 to the top of column 2 as reflux. The liquid obtained in the bottom of column 2 is discharged through line 8.

The liquid obtained in the bottom of column 2 through line 8 is cooled in exchanger 10, for example by water or air, then expanded in expansion device V. The cooled and expanded liquid is fed into deethanization column 11, reboiled by heat exchanger 16. In general, column 11 works at a pressure ranging between 20 and 35 bars. The gas fraction obtained at the top of column 11 is partly condensed at a temperature ranging between 0° C. and 10° C. in heat exchanger 12, by heat exchange with a portion of a liquid withdrawn laterally from column 2.

The condensates are separated from the gas phase in drum 13. The gas phase discharged at the top of drum 13 mainly consists of methane and ethane. It can be sent to the fuel gas network or to liquefaction through line 5. The condensates collected in the bottom of separation drum 13 are sent, at a temperature preferably ranging between 0° C. and 10° C., through pump 14, to the top of column 11 as reflux. A fraction of the condensates that mainly consist of ethane is withdrawn through line 30 to be used for example in the composition of the cooling fluids circulating in circuits 100 or 200.

The hydrocarbons heavier than methane are discharged in liquid form at the bottom of column 11 through fine 17.

Figure 2:
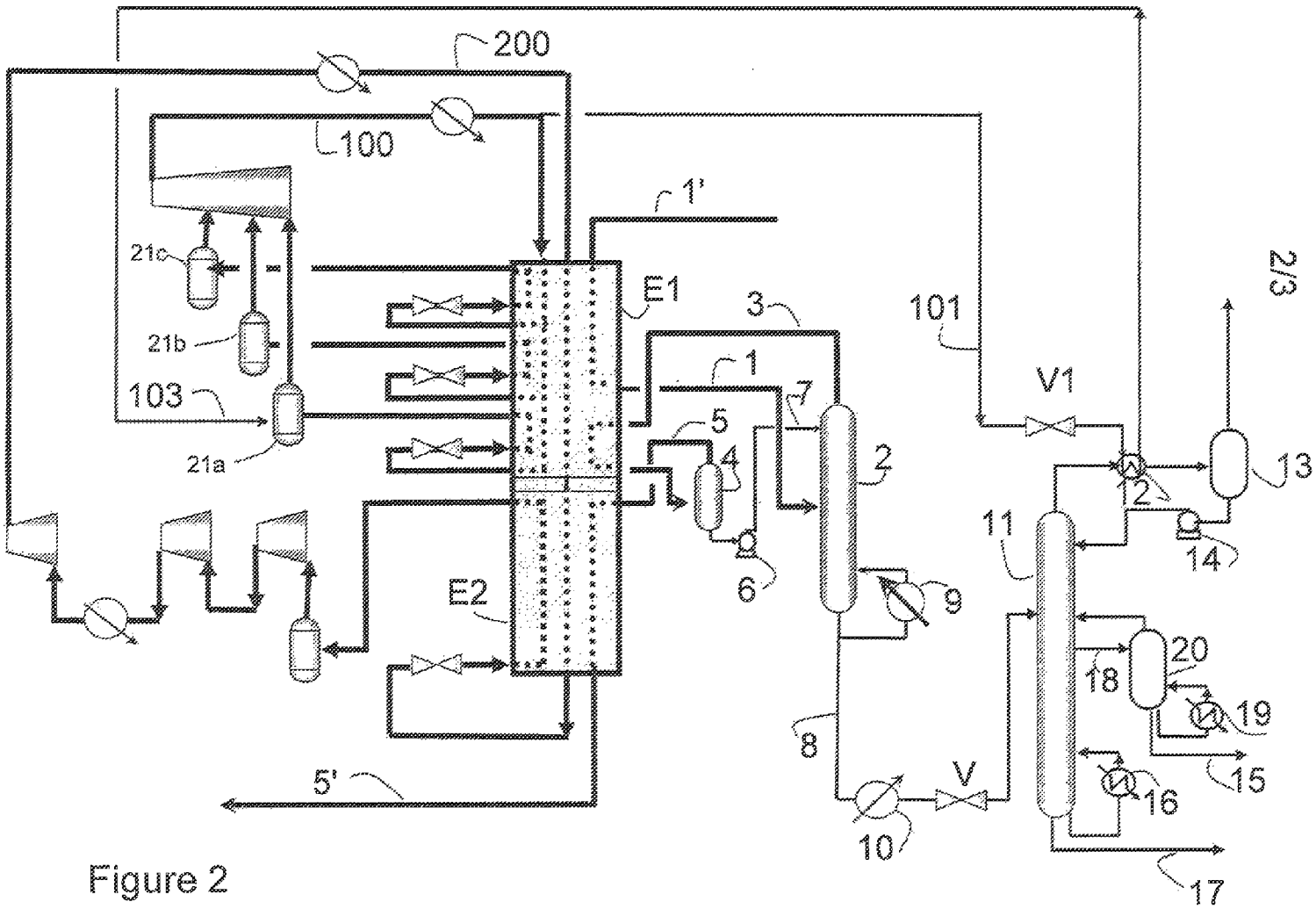
FIGS. 2 and 3 diagrammatically show two methods according to the invention.
Figure 3:
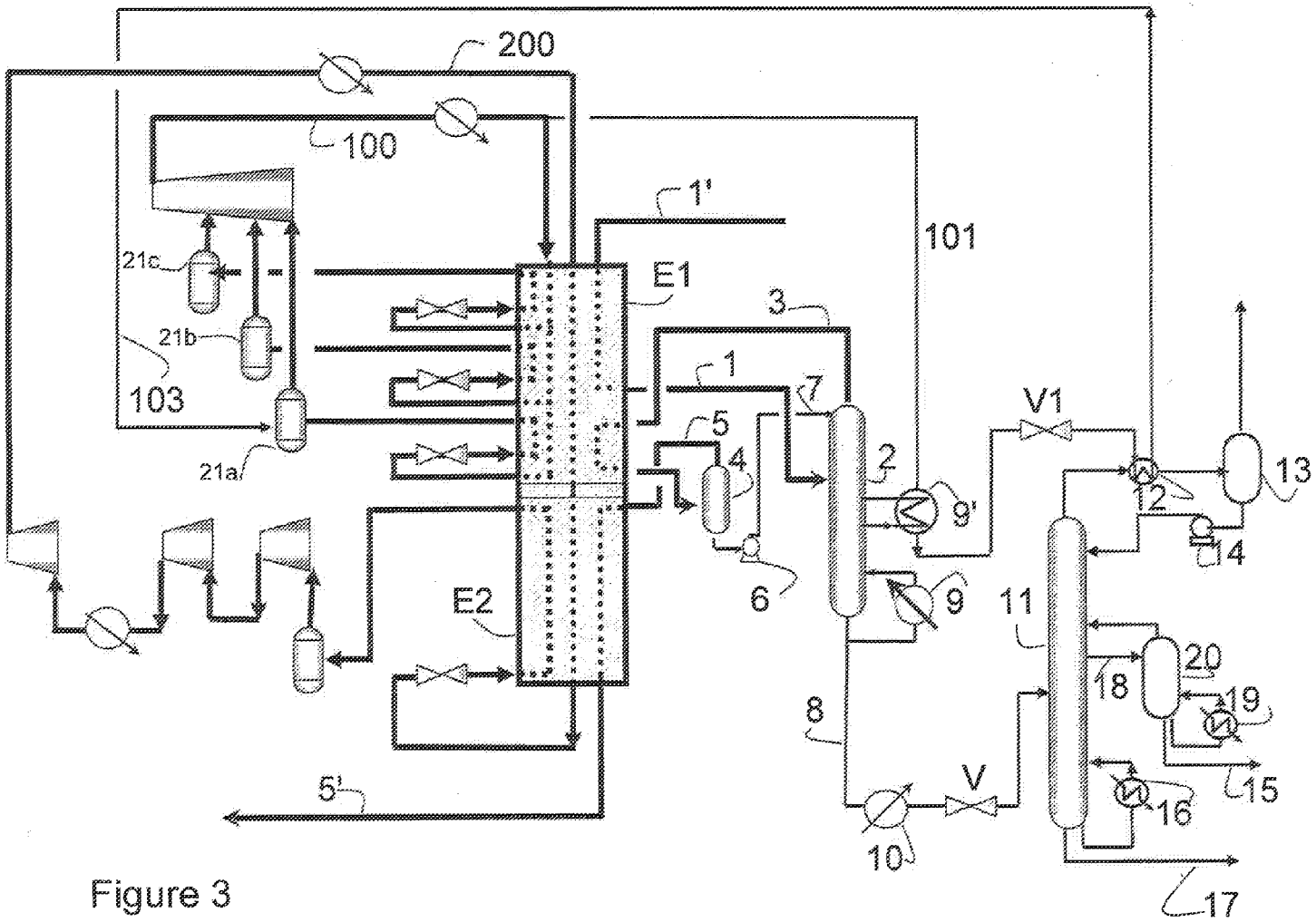

FIGS. 2 and 3, which diagrammatically illustrate two embodiments of the invention, include elements of FIG. 1 while applying different operating conditions. The reference numbers of FIGS. 2 and 3 identical to those of FIG. 1 designate the same elements.

According to the invention, in connection with FIGS. 2 and 3, the operating conditions in column 2 are so selected that the proportion of methane in the stream discharged through line 8 ranges between 10% and 150% by mole, preferably between 40% and 70% by mole, of the proportion of ethane in this stream. For example, the operating temperature or the operating pressure of column 2 can be modified. In general, column 2 works at a pressure ranging between 40 and 60 bars. The pressure of column 2 can be adjusted by means of a valve arranged upstream from column 2, for example on line 1 or 1'. The operating temperature of column 2 can be adjusted by modifying the reboiling power, i.e. by increasing or decreasing the amount of heat provided by reboiler 9 at the bottom of column 2. In consequence of the power adjustment of reboiler 9, the flow rate of the gas discharged through line 3 and the flow rate of the liquid discharged through line 8 are modified. In general, the power of reboiler 9 is reduced so as to increase the proportion of methane contained in the liquid at the bottom of column 2 and, consequently, liquid flow rate 8 increases.

Sending a substantial amount of methane to the bottom of column 2 allows to have a lower specific mass of vapour for an identical pressure, and therefore a higher specific mass ratio. Consequently, sending a substantial amount of methane to the bottom of column 2 according to the invention allows to achieve liquefaction at a higher pressure, which reduces the power required for liquefaction.

According to the invention, considering that the liquid discharged at the bottom of column 2 comprises a substantial amount of methane, particular operating conditions are applied to separation column 11. Column 11 can be a distillation column equipped with trays. A relatively low temperature, preferably ranging between −10° C. and −40° C., can be applied at the top of column 11 so as to improve separation between the methane and the hydrocarbons heavier than ethane. In connection with FIGS. 2 and 3, heat exchanger 12 can perform cooling to a low temperature preferably ranging between −10° C. and −40° C. The condensates collected in the bottom of separation drum 13 are sent, at a temperature preferably ranging between −10° C. and −40° C., through pump 14 to the top of column 11 as reflux.

A portion of the cooling fluid of first cooling circuit 100 can be used for low-temperature cooling in exchanger 12. In connection with FIG. 2, a portion of the cooling fluid is withdrawn through line 101 and expanded in valve V1 prior to exchanging heat in 12 with the effluent discharged at the top of column 11. In connection with FIG. 3, a portion of the cooling fluid of first cooling circuit 100 is withdrawn through line 101. This fluid is cooled by heat exchange in 9' with a liquid portion withdrawn laterally from column 2. For example, the liquid portion is withdrawn between the point of supply through line 1 of column 2 and the bottom of column 2. In heat exchanger 9', the cooling fluid can be cooled to a temperature ranging between −10° C. and 20° C. The cooled cooling mixture is expanded in device V1 so as to be partly vaporized at a temperature ranging between −10° C. and −40° C. The partly vaporized fluid is fed into exchanger 12 in order to cool and to partly liquefy the gas fraction discharged at the top of column 11. In connection with FIGS. 2 and 3, the cooling fluid from exchanger 12 is sent through line 103 to one of the droplet separators (21*a*, 21*b*, 21*c*) of the compressor of the first cooling circuit.

According to the invention, in connection with FIGS. 2 and 3, lateral withdrawal can be carried out from column 11 in order to extract an ethane-enriched cut. Liquid is withdrawn from column 11 through line 18 at a level located between the supply point on line 11 through line 8 and the reflux delivery point. Line 18 performs withdrawal at the level of a tray preferably arranged at least two trays above the supply point. The liquid withdrawn is fed through fine 18 into lateral column 20 referred to as stripping column. Column 20 works at a pressure substantially equal to the pressure of column 11, except for the pressure drops. Column 20 is reboiled by means of heat exchanger 19 in order to vaporize the methane present in the liquid withdrawn. An ethane-enriched cut comprising a very small proportion of methane and propane is recovered in the bottom of column 20. According to the invention, the power of exchanger 19 can be adjusted so as to maintain the liquid in the bottom of column 20 at a temperature ranging between 10° C. and 20° C. The vaporized fraction is discharged at the top of column 20 in order to be reintroduced into column 11. Preferably, column 20 is operated so as to obtain a liquid cut containing more than 92% by mole of ethane, preferably more than 95% by mole of ethane. The ethane-rich liquid can be used for making up the cooling mixtures used in circuits 100 and 200.

A liquid enriched in hydrocarbons heavier than ethane that can be sent through line 17 to a depropanization column is discharged at the bottom of column 11. A propane-enriched cut that can be used for making up the cooling mixtures used in circuits 100 and 200 can thus be extracted.

The numerical examples given hereafter allow to illustrate the operating mode of the method according to the invention.

Example 1

The scheme illustrated by FIG. 1 according to the prior art is operated.

The pretreated and dried natural gas circulates in line 1' at a flow rate of 35,000 kmol/h, with the following composition:

| Component | Composition (mol %) |
|---|---|
| N2 | 1 |
| C1 | 90 |
| C2 | 5.5 |
| C3 | 2.1 |
| iC4 | 0.5 |
| nC4 | 0.5 |
| iC5 | 0.05 |
| nC5 | 0.05 |
| C6 | 0.05 |

-continued

| Component | Composition (mol %) |
|---|---|
| C7 | 0.05 |
| C8 | 0.05 |
| C9 | 0.05 |
| Benzene | 0.05 |
| Toluene | 0.05 |

The gas is cooled in E1 to a temperature of −30° C., than fed into fractionating column 2.

Distillation of the gas in column 2 requires remaining sufficiently below the critical conditions. A criterion commonly used by the person skilled in the art is that the ratio of the specific masses of the liquid and vapour phases in the bottom of column 2 must remain above a certain value to be able to operate. Values between 3 and 6 are used by the person skilled in the art. A value of 4.5 is used in Example 1.

Column 2 works at 40.5 bars, condenser 4 at −60° C., and the C1/C2 ratio in the bottom of column 2 is 1%.

Under such conditions, a specific mass of liquid of 404.8 kg/m$^3$ and a specific mass of vapour of 88.95 kg/m$^3$ are obtained in the bottom of column 2. Thus, the ratio of the specific masses of the liquid and vapour phases in the bottom of column 2 is 4.55.

Liquefaction is thus carried out in E2 at a pressure of 40 bars. For the whole liquefaction process, a total power of 162.4 MW is necessary for the compressors of the two cooling-mixture cycles.

In Example 1, deethanization column 11 comprises no lateral column. Furthermore, the stream obtained at the top of column 1 is cooled only by heat exchange with lateral withdrawal from fractionating column 2, and it does therefore not increase the refrigerating power required for operation of the process.

Example 2

Scheme 2 according to the invention is carried out.

The composition and the flow rate of the gas to be treated are identical to those given in Example 1.

The gas is cooled in E1 to a temperature of −30° C., then fed into fractionating column 2.

Column 2 works at 53.5 bars, condenser 4 at −60° C., and the C1/C2 ratio in the bottom of column 2 is 55%.

Under such conditions, a specific mass of liquid of 405.6 kg/m$^3$ and a specific mass of vapour of 87.7 kg/m$^3$ are obtained in the bottom of column 2. Thus, the ratio of the specific masses of the liquid and vapour phases in the bottom of column 2 is 4.6.

Liquefaction is thus carried out in E2 at a pressure of 53 bars. For the whole liquefaction process, a total power of 148.3 MW is necessary for the compressors of the two cooling-mixture cycles, i.e. a gain of about 9% in relation to Example 1.

On the other hand, this efficiency gain involves difficulty in recovering an ethane-enriched stream necessary for the heat carrier makeup of cooling circuits 100 and 200. In fact, a simple distillation in separation column 11 allows to obtain, at the top, a mixture of C1 and C2 that can be used in second cooling cycle 200, but not in first cycle 100 that uses a mixture of C2 and C3. The invention aims to use in example 2 lateral stripping column 20.

The stream at the top of column 11 is cooled to a temperature of −20° C. by heat exchange with a portion of the heat-carrying fluid from first cooling circuit 100. Furthermore, the effluent discharged at the top of drum 13 has to be liquefied. These additional heat exchanges lead to an efficiency loss of about 1% in relation to Example 1.

Finally, the operating mode according to the invention of Example 2 is much more attractive than the operating mode of Example 1: it allows to save approximately 8% energy or to increase the liquefaction capacity by about 8% with the same gas turbines.

The invention claimed is:

1. A method of liquefying a natural gas, comprising:

a) cooling the natural gas by heat exchange with a cooling fluid circulating in a cooling circuit, b) feeding the cooled natural gas into a fractionating column so as to separate a methane-rich gas phase and a liquid phase rich in compounds heavier than ethane, c) discharging said liquid phase at the bottom of the fractionating column and discharging said gas phase at the top of the fractionating column, d) partly liquefying said gas phase so as to produce a condensate and a gaseous stream, said condensate being recycled to the top of the fractionating column as a first liquid reflux, e) liquefying said gaseous stream, wherein the gas stream is cooled by heat exchange at a pressure above 50 bars;

f) feeding said liquid phase into a separation column to separate a methane-rich gas fraction at the top and a liquid fraction comprising hydrocarbons heavier than ethane at the bottom, said separation column having a top and below the top a supply point, partly condensing said methane-rich gas fraction obtained in stage f) by heat exchange with a portion of said cooling fluid, so as to obtain a second liquid reflux, and feeding the second liquid reflux into the top of the separation column at a temperature ranging between −10° C. and −40° C., wherein said portion of said cooling fluid is subcooled before such heat exchange with said methane-rich gas fraction obtained in stage f) by heat exchange with a liquid discharged from the fractionating column, g) withdrawing an ethane-enriched liquid portion from an intermediate level in the separation column, and h) extracting from said liquid portion from step g) a liquid stream comprising more than 95% by mole of ethane, wherein the fractionating column is operated at operating conditions selected such that said liquid phase from step c) comprises a molar proportion of methane ranging between 40% and 70% of a molar proportion of ethane contained in said liquid phase, said fractioning column being operated at a pressure between 40-60 bar.

2. The method as claimed in claim 1, wherein the molar proportion of methane in relation to the molar proportion of ethane of said liquid phase is adjusted by modifying the power of a reboiler arranged in the bottom of the fractionating column.

3. The method as claimed in claim 1 wherein, in stage g), the liquid portion is discharged at a level located between the supply point and the top of the separation column.

4. The method as claimed in claim 1, wherein in stage h), part of said liquid portion is vaporized so as to obtain said liquid stream comprising more than 95% by mole of ethane, said vaporized part being fed into the separation column.

5. The method as claimed in claim 4, wherein in stage g), the liquid portion is discharged at a level located between the supply point and the top of the separation column.

6. The method as claimed in claim 1, wherein the liquifying of said gaseous stream in step e) is conducted at a pressure of at least 53.5 bar.

7. The method as claimed in claim 1, wherein the liquifying of said gaseous stream in step e) is conducted at a pressure of 53.5 bar.

8. A method of liquefying a natural gas, comprising:

a) cooling the natural gas by heat exchange with a cooling fluid circulating in a cooling circuit, b) feeding the cooled natural gas into a fractionating column so as to separate a methane-rich gas phase and a liquid phase rich in compounds heavier than ethane, c) discharging said liquid phase at the bottom of the fractionating column and discharging said gas phase at the top of the fractionating column, d) partly liquefying said gas phase so as to produce a condensate and a gaseous stream, said condensate being recycled to the top of the fractionating column as a first liquid reflux, e) liquefying said gaseous stream, wherein the gas stream is cooled by heat exchange at a pressure above 50 bars;

f) feeding said liquid phase into a separation column to separate a methane-rich gas fraction at the top and a liquid fraction comprising hydrocarbons heavier than ethane at the bottom, said separation column having a top and below the top a supply point, partly condensing said methane-rich gas fraction obtained in stage f) by heat exchange with a portion of said cooling fluid, so as to obtain a second liquid reflux, and feeding the second liquid reflux into the top of the separation column at a temperature ranging between −10° C. and −40° C., wherein said portion of said cooling fluid is subcooled before such heat exchange with said methane-rich gas fraction obtained in stage f) by heat exchange with a liquid discharged from the fractionating column, g) withdrawing an ethane-enriched liquid portion from an intermediate level in the separation column, and h) extracting from said liquid portion from step g) a liquid stream comprising more than 95% by mole of ethane, and using the liquid stream for making up the cooling fluid, wherein the fractionating column is operated at operating conditions selected such that said liquid phase from step c) comprises a molar proportion of methane ranging between 40% and 70% of a molar proportion of ethane contained in said liquid phase, said fractioning column being operated at a pressure between 40-60 bar.

* * * * *